US009341196B2

(12) United States Patent
Kawamoto et al.

(10) Patent No.: US 9,341,196 B2
(45) Date of Patent: May 17, 2016

(54) HYDRAULIC OIL TANK ATTACHMENT STRUCTURE OF CONSTRUCTION MACHINE

(75) Inventors: Junya Kawamoto, Tsuchiura (JP); Kohei Maeda, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 339 days.

(21) Appl. No.: 14/002,475

(22) PCT Filed: Mar. 12, 2012

(86) PCT No.: PCT/JP2012/056298

§ 371 (c)(1),
(2), (4) Date: Aug. 30, 2013

(87) PCT Pub. No.: WO2012/124658

PCT Pub. Date: Sep. 20, 2012

(65) Prior Publication Data

US 2014/0000726 A1 Jan. 2, 2014

(30) Foreign Application Priority Data

Mar. 17, 2011 (JP) ..... 2011-059217

(51) Int. Cl.
*F15B 1/26* (2006.01)
*E02F 9/08* (2006.01)

(52) U.S. Cl.
CPC ..... *F15B 1/26* (2013.01); *E02F 9/0883* (2013.01); *Y10T 137/6881* (2015.04)

(58) Field of Classification Search
USPC ..... 137/343, 351, 354, 355, 899, 899.4; 220/480, 676, 677, 682, 692, 693
See application file for complete search history.

(56) References Cited

U.S. PATENT DOCUMENTS 1,392,204 A * 9/1921 Nichols ..... B65D 81/38 220/62.18
2,837,365 A * 6/1958 Schlueter ..... E05B 65/52 220/681

(Continued)

FOREIGN PATENT DOCUMENTS

JP 2002-96649 A 4/2002
JP 2003-253699 A 9/2003

(Continued)

OTHER PUBLICATIONS

International Search Report dated Jun. 12, 2012 with partial English translation (three (3) pages).

(Continued)

*Primary Examiner* — Kevin Murphy
*Assistant Examiner* — Jonathan Waddy
(74) *Attorney, Agent, or Firm* — Crowell & Moring LLP

(57) ABSTRACT

A hydraulic oil tank attachment structure arranged in a construction machine secures the strength of a hydraulic oil tank as well as secures a large capacity thereof. The attachment structure is arranged in a compact excavator provided with a revolving superstructure, a working device attached to the revolving superstructure, a hydraulic actuator including a revolving motor that drives the revolving superstructure and an actuator that drives the working device. A hydraulic oil tank made of synthetic resin, which stores hydraulic oil to be supplied to the hydraulic actuator, is attached on a revolving frame of the revolving superstructure. The hydraulic oil tank attachment structure has a holding member provided with a projecting part formed on a side surface of the tank, which is fixed on the revolving frame of the revolving superstructure so as to surround side surfaces thereof to hold the hydraulic oil tank via the projecting part.

4 Claims, 12 Drawing Sheets

(56) References Cited

U.S. PATENT DOCUMENTS

| | | | | | |
|---|---|---|---|---|---|
| 4,006,852 | A * | 2/1977 | Pilsner | B60R 11/00 | 224/401 |
| 4,616,872 | A * | 10/1986 | Akira | B62D 33/06 | 180/89.12 |
| 4,936,349 | A * | 6/1990 | Cowgur | B60P 3/30 | 137/590 |
| 5,778,471 | A * | 7/1998 | Collison | D06F 39/12 | 137/359 |
| 8,267,217 | B2 * | 9/2012 | Kotani | B62D 33/0617 | 180/312 |
| 2008/0314854 | A1 * | 12/2008 | Kamiya | B66C 13/56 | 212/289 |
| 2013/0341481 | A1 * | 12/2013 | Sasaki | B60K 15/067 | 248/503 |

FOREIGN PATENT DOCUMENTS

| | | | |
|---|---|---|---|
| JP | 2005-105709 | A | 4/2005 |
| JP | 2009-74310 | A | 4/2009 |
| JP | 2010-120509 | A | 6/2010 |

OTHER PUBLICATIONS

European Search Report dated Dec. 3, 2014 (six pages).

* cited by examiner

HYDRAULIC OIL TANK ATTACHMENT STRUCTURE OF CONSTRUCTION MACHINE

TECHNICAL FIELD

The present invention relates to a hydraulic oil tank attachment structure of a construction machine, which is arranged in such as a compact excavator and is used for attaching a hydraulic oil tank on a revolving frame of a revolving superstructure.

BACKGROUND ART

Generally, in a construction machine such as an excavator comprising a revolving superstructure, a working device of a boom, an arm, a bucket, etc. that is attached to the revolving superstructure, and a hydraulic actuator including a revolving motor that drives the revolving superstructure and an actuator that drives the working device, a hydraulic oil tank made of iron, i.e., an iron hydraulic oil tank that is capable of storing therein pressure oil to be supplied to the hydraulic actuator described above is often provided in order to secure the strength of the tank. On the other hand, as in the case of a compact excavator, when installing a hydraulic tank together with other devices such as an engine, a hydraulic pump, a control valve, and a revolving motor on the revolving superstructure of which a space for installing devices is so small, a hydraulic oil tank made of synthetic resin is used because such a tank can be easily formed in the complex shape. A hydraulic oil tank made of synthetic resin requires less paints and anti-rust treatments and is lighter in weight than the hydraulic oil tank made of iron, and has the advantage that the heat of hydraulic oil stored therein is hardly transferred to an outside.

The patent document 1 discloses a structure for fixing such a hydraulic oil tank made of synthetic resin on a floor plate, that is, a hydraulic oil tank attachment structure. The conventional technique disclosed in the patent document 1 is configured such that a supporting pole passage for accommodating therein a supporting pole for fixing a hydraulic oil tank to a floor plate is provided in the inside of the hydraulic oil tank made of synthetic resin, of which side surfaces are formed in the shape of a plate.

PRIOR ART DOCUMENT

Patent Document

Patent Document 1: Japanese Patent Application Laid-Open No. 2002-96649

SUMMARY

Problems to be Solved by the Invention

In the conventional technique provided in the patent document 1 mentioned above, the side surfaces of the hydraulic oil tank are formed in the shape of a plate, and accordingly the strength of the hydraulic oil tank is relatively small. Consequently, when hydraulic oil stored within the hydraulic oil tank shakes during an operation performed by a working device and then the pressure within the hydraulic oil tank is increased or decreased, there is a possibility that the hydraulic oil tank is deformed or damaged. Furthermore, the supporting pole passage provided to accommodate therein the supporting pole for supporting and fixing the hydraulic oil tank is formed within the hydraulic oil tank, and accordingly there is a problem that a capacity of the hydraulic oil tank becomes smaller by a space provided for the supporting pole passage.

The present invention was made in view of such problems stemming from the conventional technique described above, and an object of the present invention is to provide a hydraulic oil tank attachment structure of a construction machine which can secure the strength of a hydraulic oil tank as well as secure a large capacity thereof.

Means for Solving the Problem

In order to achieve the object described above, the present invention provides a hydraulic oil tank attachment structure of a construction machine being provided with a revolving superstructure, a working device that is attached to the revolving superstructure, a hydraulic actuator including a revolving motor that drives the revolving superstructure and an actuator that drives the working device, and a hydraulic oil tank made of synthetic resin, which stores therein a hydraulic oil to be supplied to the hydraulic actuator and is attached on a revolving frame of the revolving superstructure, comprising a holding member being provided with a projecting part formed on a side surface of the hydraulic oil tank, which is fixed on the revolving frame of the revolving superstructure so as to surround side surfaces of the hydraulic oil tank so that the hydraulic oil tank is held via the projecting part.

Because the present invention is configured as the above, it is possible to secure the strength of the projecting part and the strength of the side surface near the projecting part because a projecting part is formed on the side surface of the hydraulic oil tank. This makes it possible to prevent a hydraulic oil tank from being deformed and damaged in the process of an operation performed by the working device, which is caused by increase or reduction of pressure within the tank due to heaving of the level of hydraulic oil stored therein. Furthermore, it is possible to hold the hydraulic oil tank without forming portions for supporting and fixing the hydraulic oil tank in the inside thereof because the holding member for holding the hydraulic oil tank, which is arranged out of the hydraulic oil tank so as to surround the side surfaces thereof, holds the hydraulic oil tank via the projecting part that is formed on the side surface thereof. With this configuration, it is possible to secure a larger capacity of the hydraulic oil tank.

Furthermore, according to the present invention, the holding member that is formed to be vertically extended includes an iron plate member provided with a hole formed therein and a bushing having elasticity, which is formed in the shape of a ring and fitted to the hole of the plate member of the holding member, and the projecting part of the hydraulic oil tank is inserted into the bushing that is fitted to the hole of the plate member so that the hydraulic oil tank is held by the plate member through the bushing.

Because the present invention is configured as the above, damage of the projecting part, which results from contact between the projecting part of the hydraulic oil tank made of synthetic resin and a periphery of the hole of the iron flat plate member, can be prevented by the bushing formed in the shape of a ring and having elasticity.

Furthermore, according to the present invention, the plate member includes a first plate member having a bottom plate that is attached onto the revolving frame and a standing plate that is coupled to the bottom plate and is formed to be vertically extended, a second plate member having an attaching plate that is fixed to the standing plate of the first plate member and is formed to be vertically extended and a side plate that is coupled to the attaching plate and is formed to be vertically extended, and a third plate member having an attaching plate that is attached to the standing plate of the first plate member and is formed to be vertically extended and a side plate that is coupled to the attaching plate, arranged so as to face the side plate of the second plate member, and formed to be vertically extended, holes to which the bushings are fitted are respectively formed in the side plate of the second plate member and the side plate of the third plate member, and the hydraulic oil tank that is mounted on the bottom plate of the first plate member is held by the first plate member, the second plate member, and the third plate member such that the standing plate of the first plate member, the side plate of the second plate member, and the side plate of the third plate member surround three side surfaces of the hydraulic oil tank.

Because the present invention is configured as the above, it is possible to simplify the production process of the holding member because the holding member is simply configured by the first plate member, the second plate member, and the third plate member, which are respectively made of flat plates. In addition, the holding member holds the hydraulic oil tank so as to surround the three side surfaces of the hydraulic oil tank that is mounted on the bottom plate of the first plate member, and accordingly it is possible to stably hold the hydraulic oil tank with respect to shaking caused in association with an operation performed by the working device.

Furthermore, according to the present invention, a hole that accommodates a connecting part for connecting a supplying pipe that is provided in a bottom of the hydraulic oil tank is formed in the bottom plate of the first plate member, a hole for reduction in weight is formed in the side plate of the second plate member, and a hole for reduction in weight is formed in the side plate of the third plate member.

Because the present invention is configured as the above, the holes for reduction in weight are respectively formed in the second plate member and the third plate member, and accordingly it is possible to reduce the weight of the holding member and a load on the revolving frame, which is generated by the hydraulic oil tank attachment structure, can be reduced.

Furthermore, according to the present invention, a fixing bracket is provided on the revolving frame and an attaching bracket that is attached to the fixing bracket is provided on an under surface of the bottom plate.

Because the present invention is configured as the above, the hydraulic oil tank is held via the attaching brackets that are provided on the bottom surface of the bottom plate of the first plate member and the fixing brackets that are provided on the revolving frame, and accordingly it is possible to stably hold the hydraulic oil tank at a desired height.

Effect of the Invention

According to the present invention, it is possible to secure the strength of a hydraulic oil tank because a projecting part is formed in a side surface of the hydraulic oil tank. With this configuration, it is possible to prevent the hydraulic oil tank from being deformed and damaged in the process of an operation performed by a working device, which is caused by increase or reduction of pressure within the tank due to heaving of the level of hydraulic oil stored therein. Consequently, it is possible to increase the durability of the hydraulic oil tank more than that of the conventional tank. Furthermore, according to the present invention, it is possible to hold the hydraulic oil tank without forming portions for supporting and fixing the hydraulic oil tank in the inside thereof because a holding member that is arranged to face side surfaces of the hydraulic oil tank holds the hydraulic oil tank via the projecting part that is formed therein. This makes it possible to secure a larger capacity of the hydraulic oil tank and thus improve an operating performance of a construction machine more than that of the conventional construction machine. When a capacity of the tank is set to be equal to the conventional one, it is possible to realize downsizing of the hydraulic oil tank. Moreover, as in the case of a compact excavator where a space for installing devices is so small that a position for installing them is restricted, it is possible to increase the flexibility for layout design of the devices to be installed around the hydraulic oil tank.

DESCRIPTION OF EMBODIMENTS

Hereinafter, an embodiment of a hydraulic oil tank attachment structure of a construction machine according to the present invention will be described with reference to the drawings.

Figure 1:
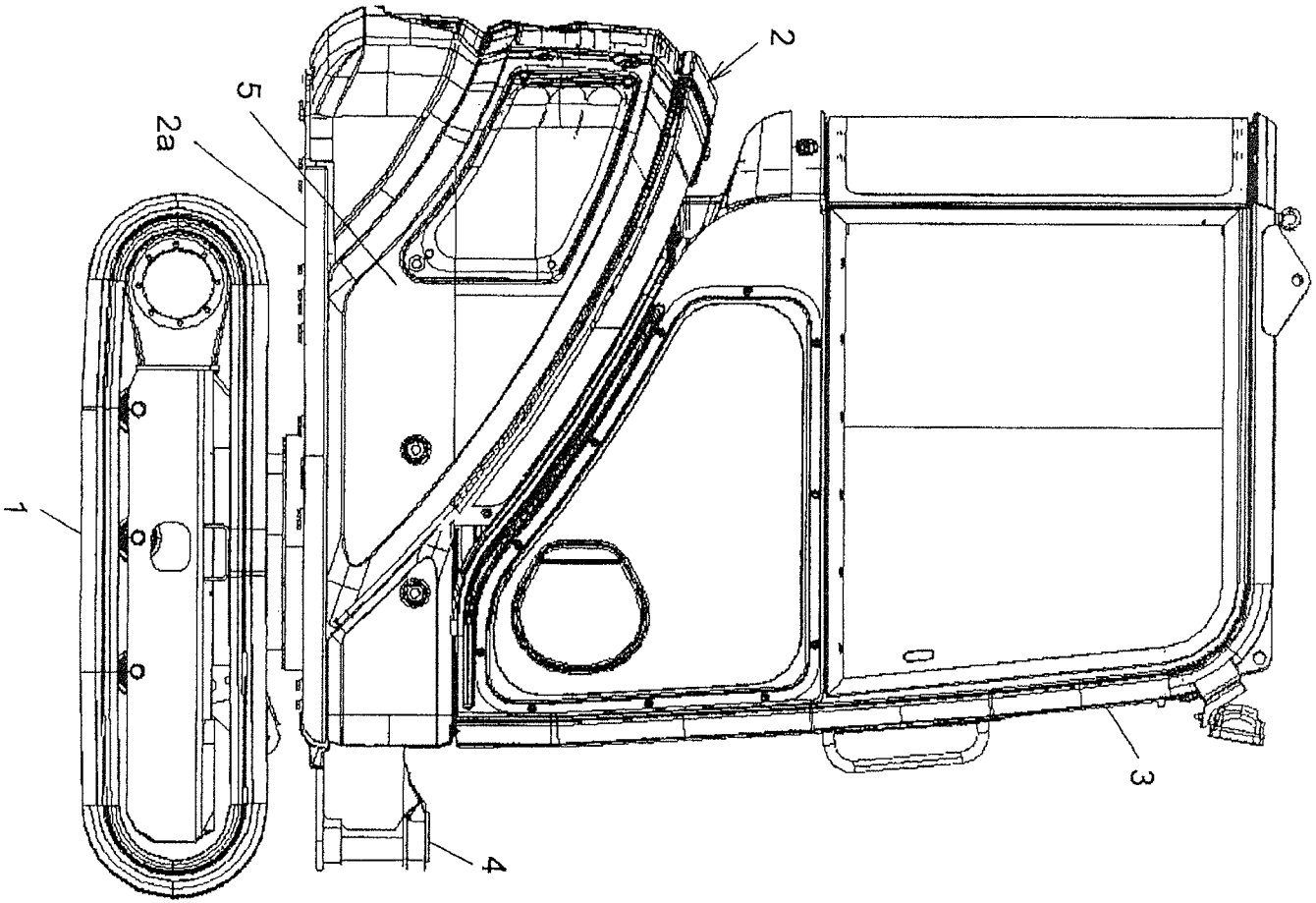
FIG. 1 is a side view of a main part of a compact excavator that is shown as an example of a construction machine including an embodiment of a hydraulic oil tank attachment structure according to the present invention.
Figure 2:
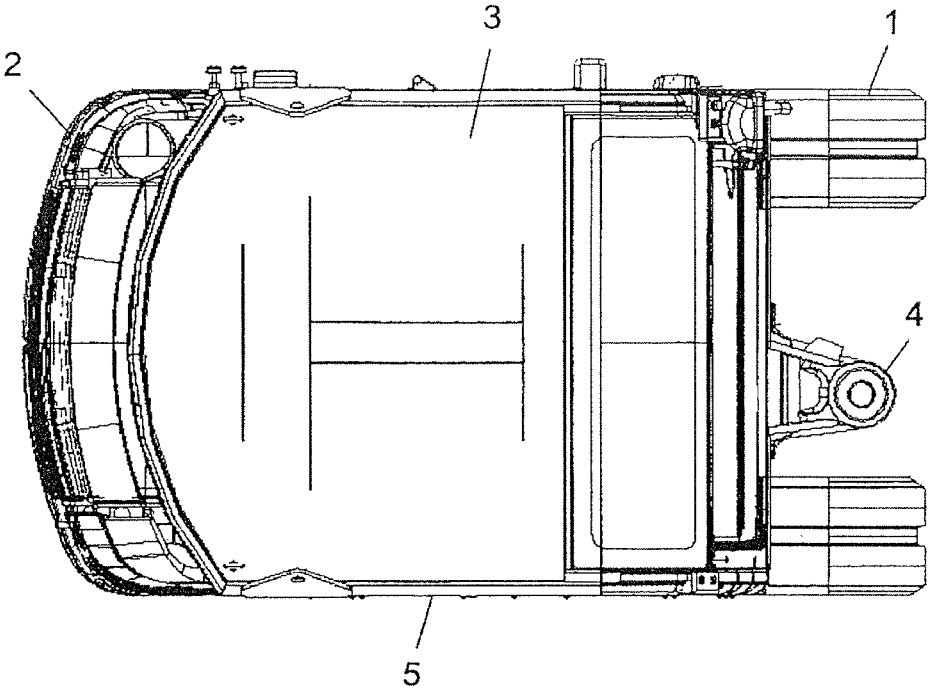
FIG. 2 is a top view of a main part of the compact excavator of FIG. 1.
Figure 3:
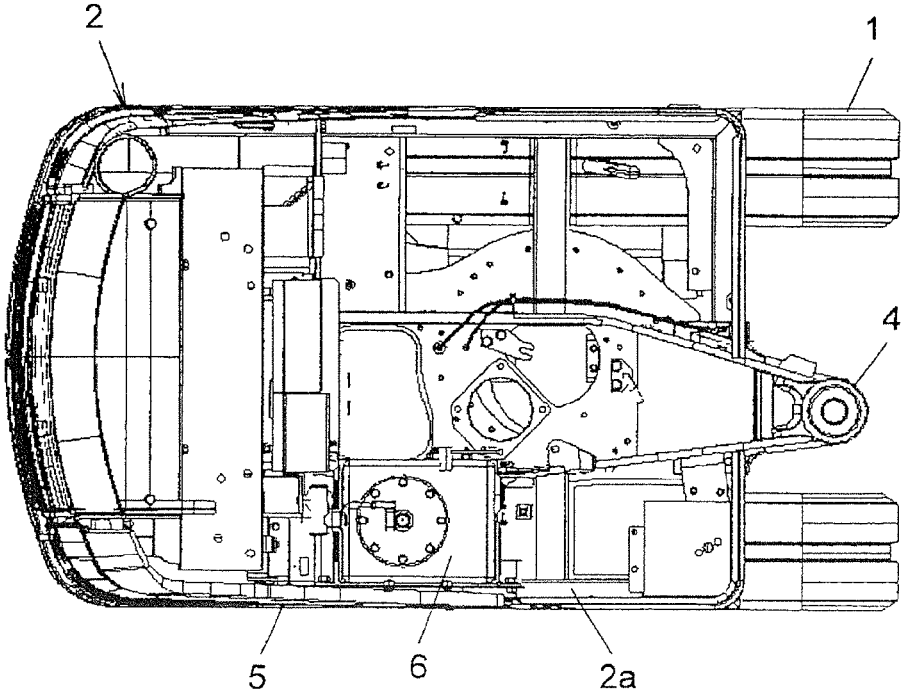
FIG. 3 is a top view of a main part of the compact excavator of FIG. 2, of which an operator's cab is removed.
Figure 4:
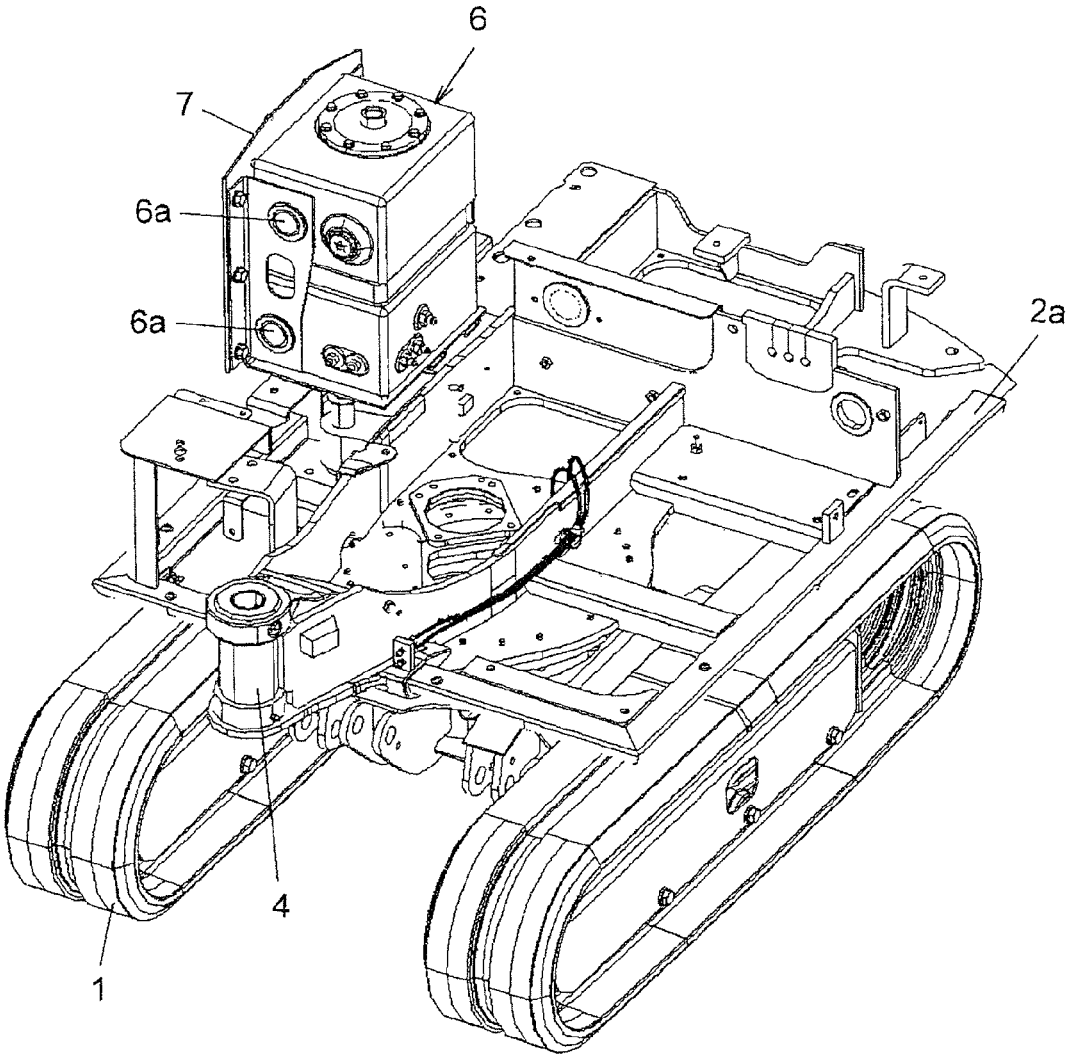
FIG. 4 is a perspective view of a main part of the compact excavator of FIG. 3, which is illustrated from the front side.
Figure 5:
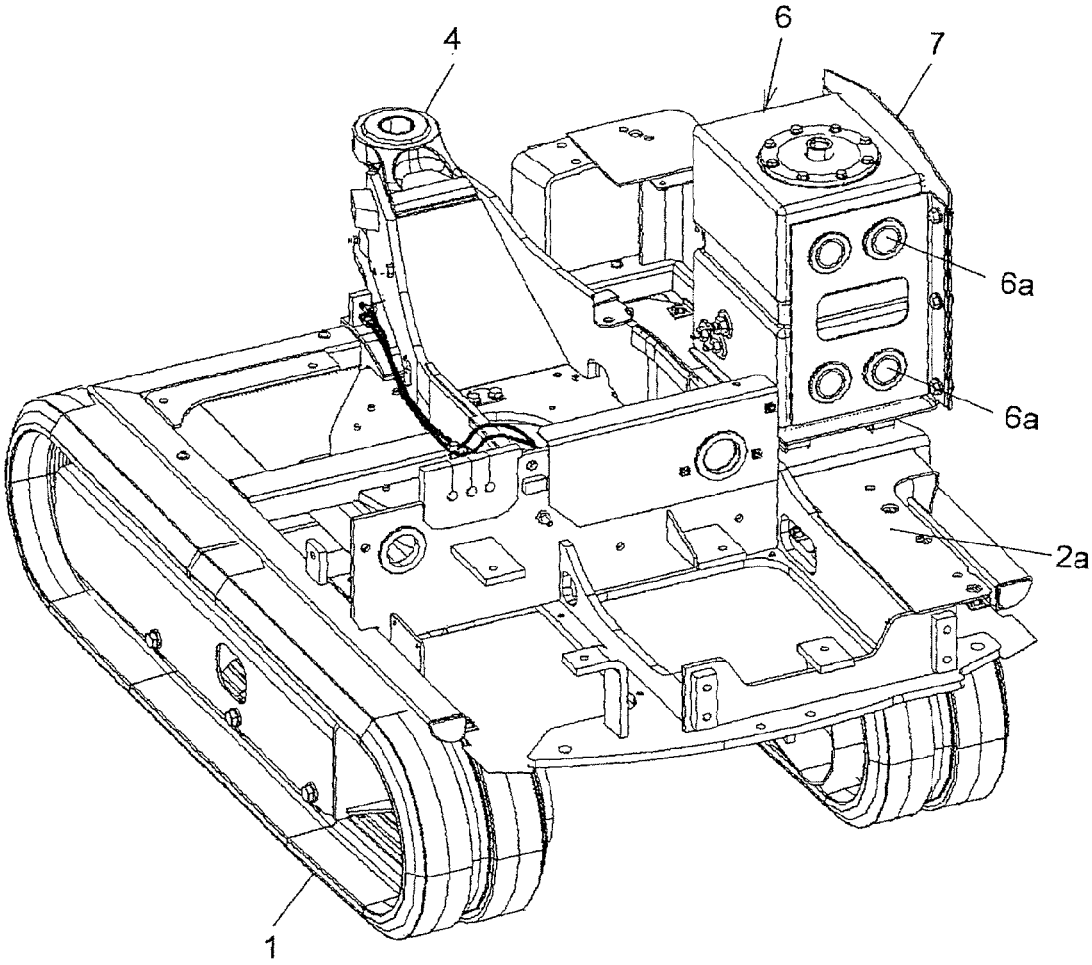
FIG. 5 is a perspective view of a main part of the compact excavator of FIG. 3, which is illustrated from the rear side.

A construction machine that includes a hydraulic oil tank according to the present embodiment is, for example, a compact excavator of which a rear end revolves within the width of a machine body. Such a compact excavator offers only a small space for installing various devices therein, and thus a position for installing the hydraulic oil tank therein is likely to be restricted. As illustrated in FIGS. 1 to 3, the compact excavator includes an undercarriage 1 and a revolving superstructure 2 that is arranged on the undercarriage 1. The revolving superstructure 2 is provided with an operator's cab 3. A working device (not shown) is attached to a working-device attachment part 4. The working device includes a hydraulic actuator that drives such as a boom, an arm, a bucket, a boom cylinder, an arm cylinder, and a bucket cylinder to excavate the sand, etc. The compact excavator also includes a travel motor that makes the undercarriage 1 move and a hydraulic actuator including such as a revolving motor that makes the revolving superstructure 2 revolve. The hydraulic oil tank according to the present embodiment is made of synthetic resin, and as illustrated in FIGS. 4 and 5, is attached on a revolving frame 2*a* of the revolving superstructure 2 so as to be located closely to an exterior cover 5 of the revolving superstructure 2.

In the present embodiment, as illustrated in FIGS. 6 to 9, a plurality of projecting parts 6*a* are formed on a side surface of a hydraulic oil tank 6. Furthermore, a holding member 7 that holds the hydraulic oil tank 6 via the projecting parts 6*a* and is fixed on the revolving frame 2*a* of the revolving superstructure 2 so as to surround side surfaces of the hydraulic oil tank 6 is also formed therein.

Figure 6:
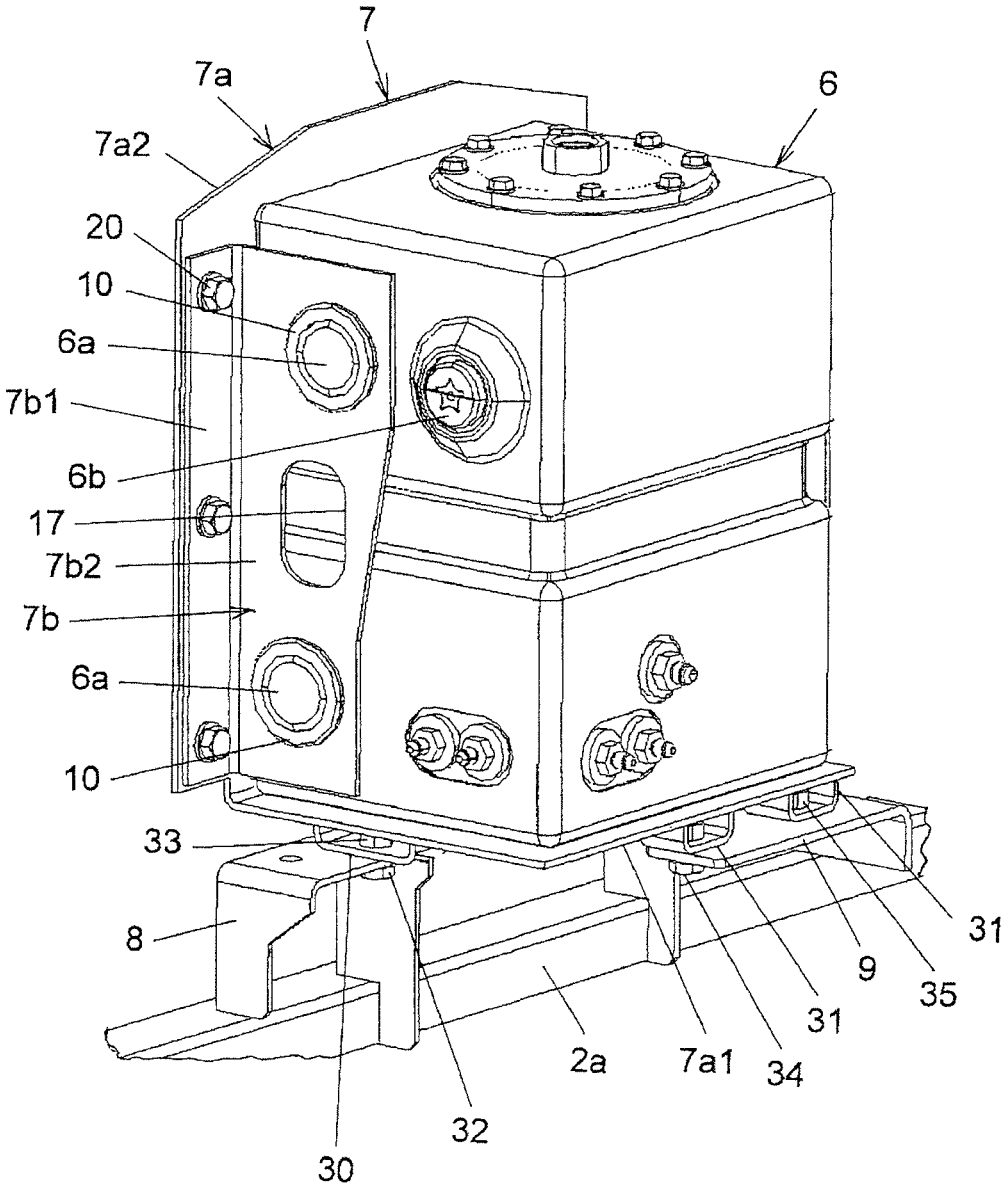
FIG. 6 is an enlarged view of a main part of the compact excavator of FIG. 4.
Figure 7:
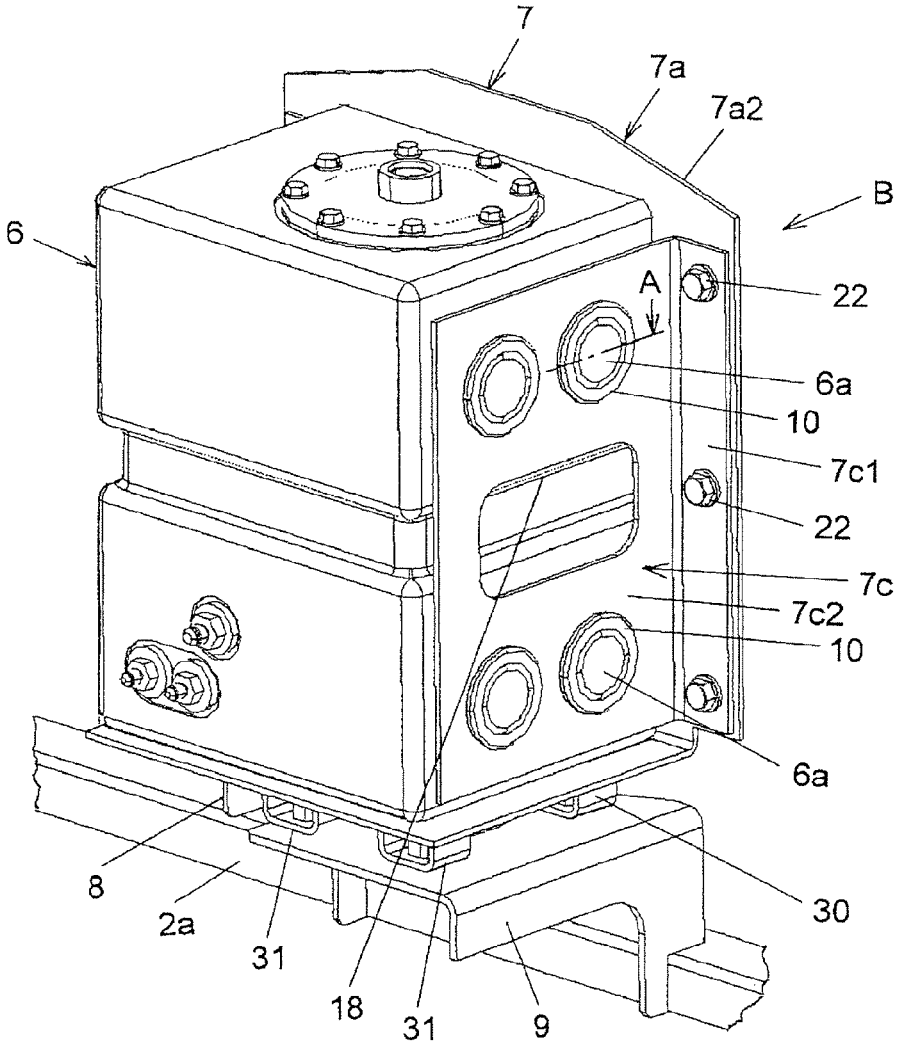
FIG. 7 is an enlarged view of a main part of the compact excavator of FIG. 5.
Figure 8:
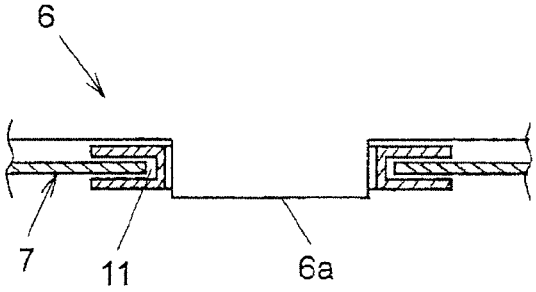
FIG. 8 is a cross-sectional enlarged view of the line A of FIG. 7.
Figure 14:
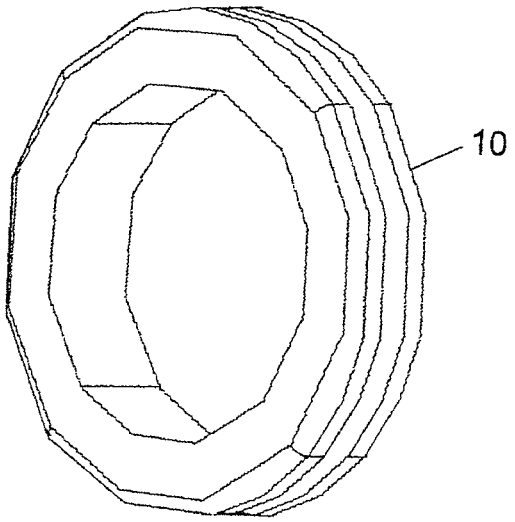
FIG. 14 is a perspective view of a bushing that is arranged in a hydraulic oil tank attachment structure according to the present embodiment.

As described below, the holding member 7 that is formed to be vertically extended includes an iron plate member in which a plurality of holes 11 are provided. As illustrated in FIGS. 6, 7, and 14, in the present embodiment, a bushing 10 having elasticity is provided. The bushing 10 is, for example, made of rubber and formed in the shape of a ring. The bushing 10 is fitted to the hole 11 that is provided in the plate member of the holding member 7 so that the projecting part 6*a* of the hydraulic oil tank 6 is inserted therein, and thereby the hydraulic oil tank 6 is held by the plate member via the bushing 10.

Figure 10:
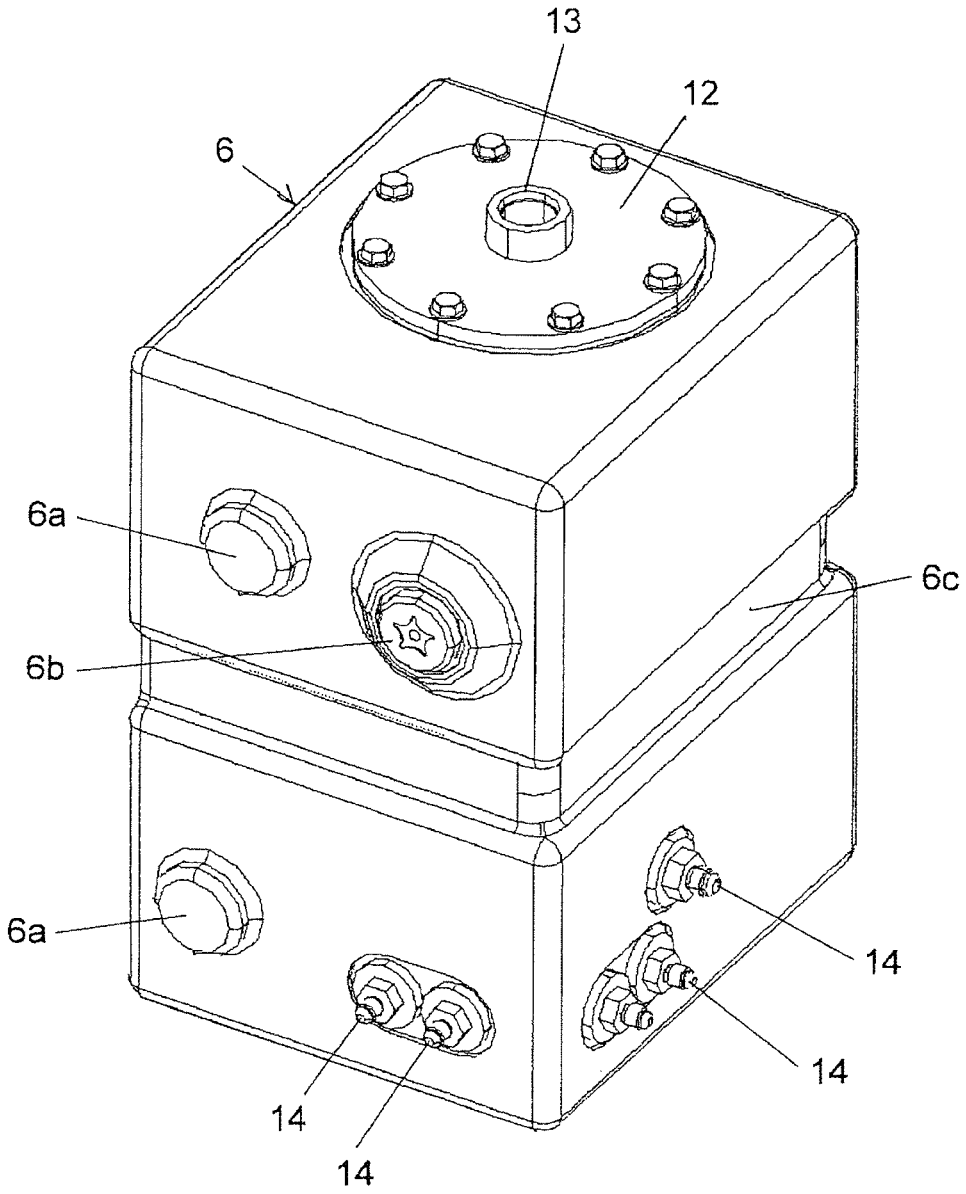
FIG. 10 is a perspective view of a hydraulic oil tank to be attached by the present embodiment, which is illustrated from the front side.
Figure 11:
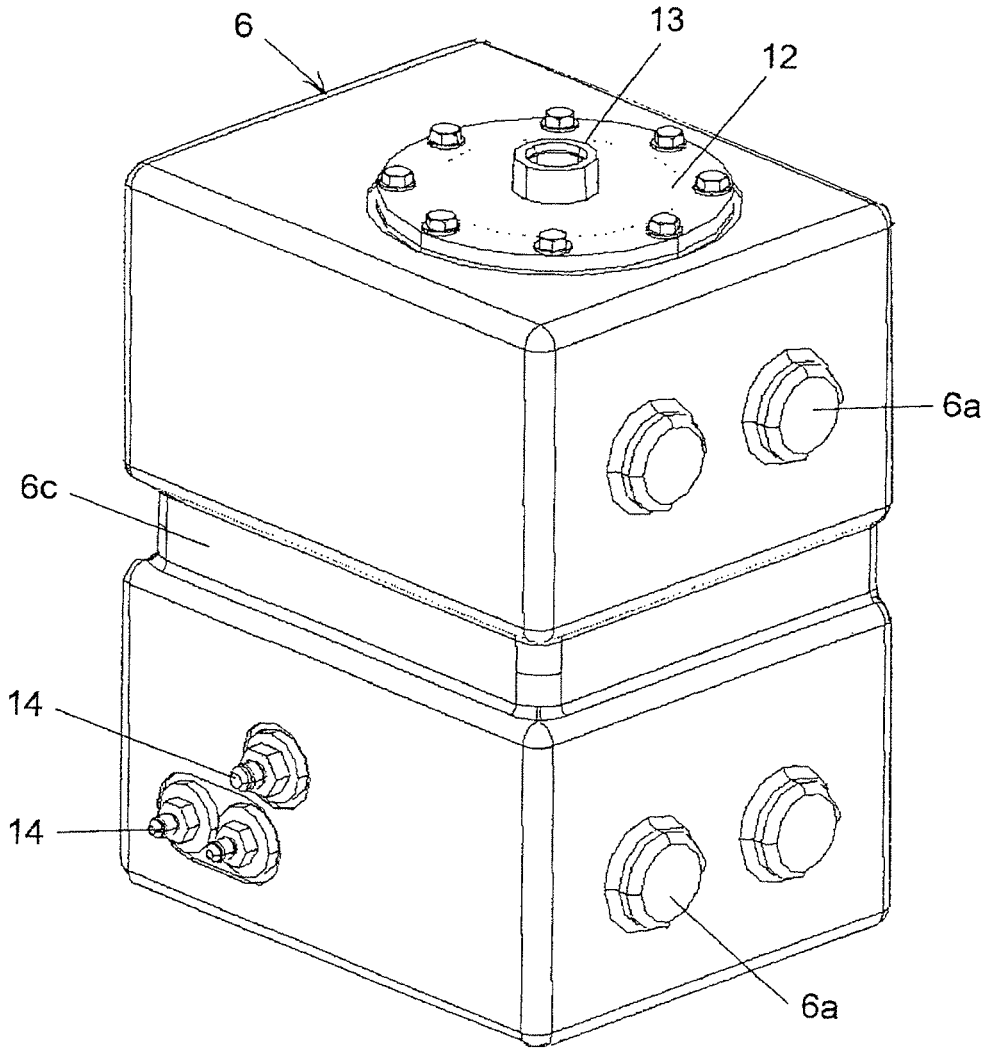
FIG. 11 is a perspective view of a hydraulic oil tank to be attached by the present embodiment, which is illustrated from the rear side.

As illustrated in FIGS. 10 and 11, for example, the hydraulic oil tank 6 described above is basically formed in the shape of a rectangle and includes a strip-shaped groove that is formed in the middle thereof, that is, includes a concavo-convex part 6*c* of which a front side is formed concavely and the other side is formed convexly. By the concavo-convex part 6*c*, the basic strength of the overall hydraulic oil tank 6 made of synthetic resin is secured. Furthermore, the hydraulic oil tank 6 includes a filter 12 that filters hydraulic oil to maintain it clean, a connecting pipe 13 that is provided at the filter 12 and is connected to a returning pipe for guiding oil that returns from the hydraulic actuator, and a connecting part 14 that is connected to a drainpipe. The hydraulic oil tank 6 also includes another connecting part that is connected to a supplying pipe (not shown) at a downside thereof. As illustrated in FIG. 10, the hydraulic oil tank 6 further includes a gauge 6*b* that is formed to project from the side surface of the hydraulic oil tank 6. The gauge 6*b* is formed to be hollow and includes a transparent body that offers a view into the oil level of the hydraulic oil within the hydraulic oil tank 6. For example, as illustrated in FIG. 10, the two projecting parts 6*a* described above are provided on one of the side surfaces of the hydraulic oil tank 6, and four projecting parts 6*a* are provided on the opposite side surface of the hydraulic oil tank 6. These projecting parts 6*a*, for example, are all formed in the equal shape and size to be in the shape of a frustum.

Figure 9:
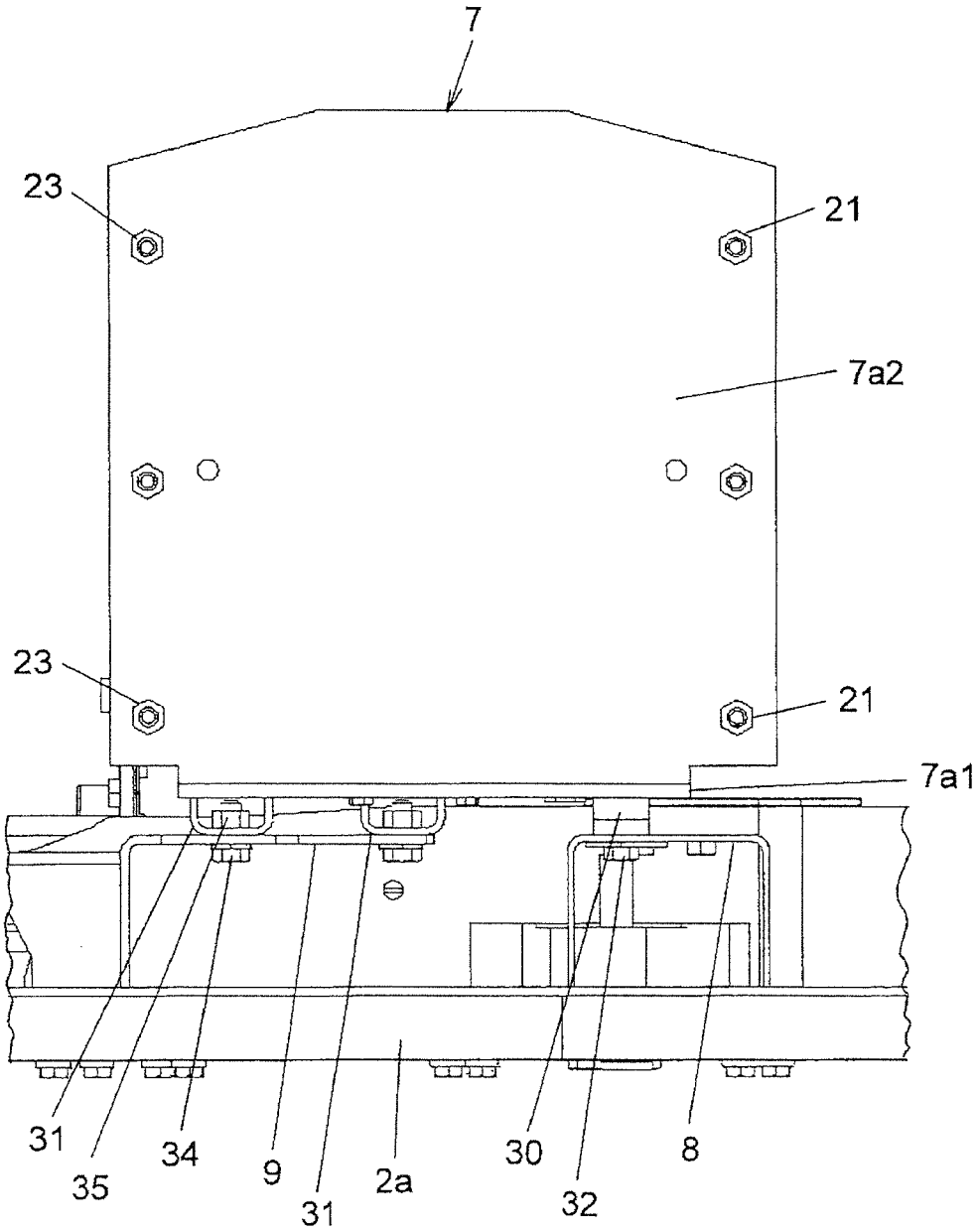
FIG. 9 is a view illustrated from the direction B of FIG. 7.
Figure 12:
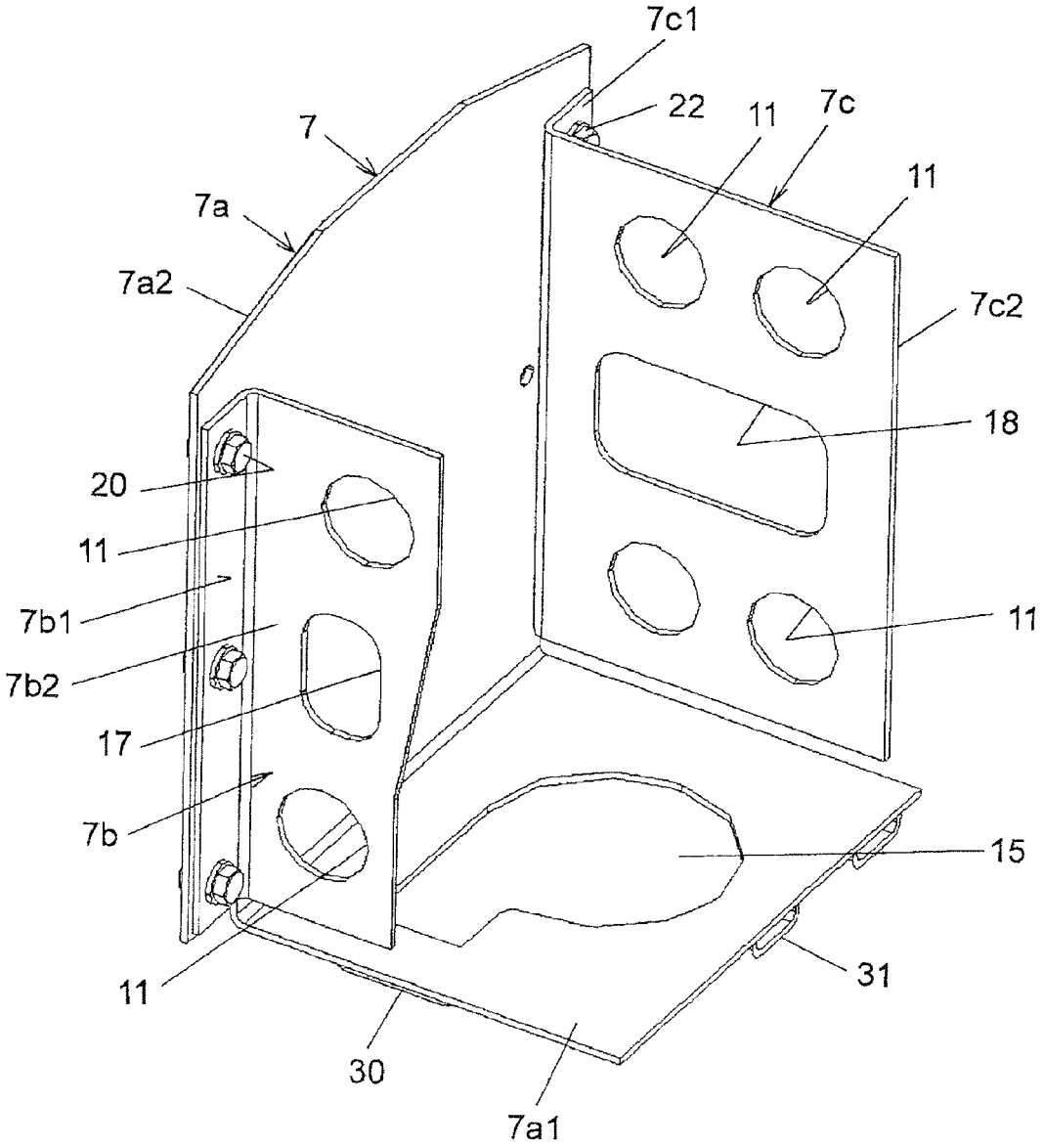
FIG. 12 is a perspective view of a holding member that holds a hydraulic oil tank to be attached by the present embodiment.
Figure 13:
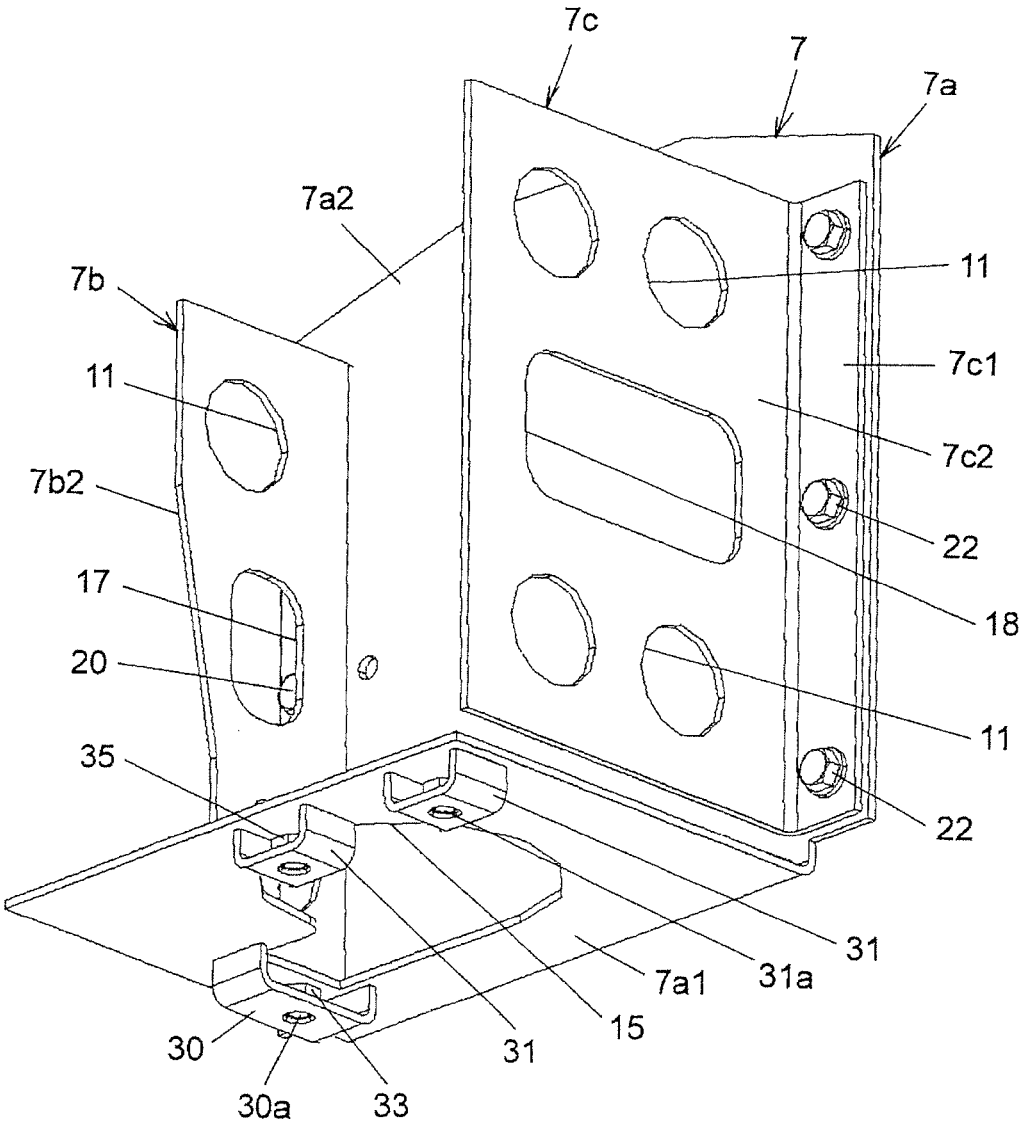
FIG. 13 is a perspective view of the holding member of FIG. 12, which is illustrated from the bottom side.

The holding member 7 described above, for example, includes a plurality of plate members. That is, as illustrated in FIGS. 12 and 13, the holding member 7 includes a first plate member 7*a* that has a bottom plate 7*a*1 and a standing plate 7*a*2. The bottom plate 7*a*1 is fixed onto the revolving frame 2*a*, and the standing plate 7*a*2 that is formed to be vertically extended is coupled to the bottom plate 7*a*1. The holding member 7 also includes a second plate member 7*b*. The second plate member 7*b* is configured with an attaching plate 7*b*1 and a side plate 7*b*2. The attaching plate 7*b*1 that is formed to be vertically extended is attached by a bolt 20 to the standing plate 7*a*2 of the first plate member 7*a*. The side plate 7*b*2 that is formed to be vertically extended is coupled to the attaching plate 7*b*1. The holding member 7 further includes a third plate member 7*c*. The third plate member 7*c* is configured with an attaching plate 7*c*1 and a side plate 7*c*2. The attaching plate 7*c*1 that is formed to be vertically extended is attached by a bolt 22 to the standing plate 7*a*2 of the first plate member 7*a*. The side plate 7*c*2 that is formed to be vertically extended is coupled to the attaching plate 7*c*1 and is arranged so as to face the side plate 7*b*2 of the second plate member 7*b*. As illustrated in FIG. 9, nuts 21 and 23 with which the corresponding bolts 20 and 22 described above are to be screwed are fixed to a backside of the first plate member 7*a*.

As illustrated in FIG. 12, for example, two holes 11 to which the bushings 10 described above are to be fitted are formed in the second plate member 7*b*, and four holes 11 to which the bushings 10 are to be fitted are formed in the third plate member 7*c*. In association with the configuration above, the length in a front and back direction, which is perpendicular to a vertical direction, of the second plate member 7*b*, is set to be substantially half of the length in a front and back direction, which is perpendicular to a vertical direction, of the third plate member 7*c*.

As illustrated in FIGS. 6, 7 and 9, the hydraulic oil tank 6 is mounted on the bottom plate 7*a*1 of the first plate member 7*a* and is held by the first plate member 7*a*, the second plate member 7*b*, and the third plate member 7*c* such that three side surfaces of the hydraulic oil tank 3 are surrounded by the standing plate 7*a*2 of the first plate member 7*a*, the side plate 7*b*2 of the second plate member 7*b*, and the side plate 7*c*2 of the third plate member 7*c*.

As illustrated in FIG. 12, a hole 15 that accommodates a connecting part for connecting a supplying tube (not shown) that is provided at the bottom of the hydraulic oil tank 6 is formed in the bottom plate 7*a*1 of the first plate member 7*a*. A hole 17 for reduction in weight is formed at the center of the side plate 7*b*2 of the third plate member 7*b*, and a hole 18 for reduction in weight is formed at the center of the side plate 7*c*2 of the third plate member 7*c* as well.

Furthermore, in the present embodiment, as illustrated in FIGS. 6, 7, and 13, a first fixing bracket 8 and a second fixing bracket 9 are provided on the revolving frame 2*a*. On a bottom surface of the bottom plate 7*a*1 of the first plate member 7*a*, a first attaching bracket 30 and a second attaching bracket 31 that are respectively attached to the first and second fixing brackets 8 and 9 are arranged.

As illustrated in FIG. 13, a hole 30*a* is formed in the first attaching bracket 30 that is attached to the bottom surface of the bottom plate 7*a*1 of the first plate member 7*a*, and a nut 33 is fixed, at a position corresponding to the hole 30*a*, on a top surface of the first attaching bracket 30. A hole 31*a* is formed in the second attaching bracket 31, and a nut 35 is fixed, at a position corresponding to the hole 31*a*, on a top surface of the second attaching bracket 31. A bolt 32 illustrated in FIG. 6 is inserted into the hole 30*a* of the first attaching bracket 30 illustrated in FIG. 13 through a hole (not shown) formed in the first fixing bracket 8 so as to be screwed with the nut 33. Similarly, a bolt 34 illustrated in FIG. 6 is inserted into the hole 31*a* of the second attaching bracket 31 illustrated in FIG. 13 through a hole (not shown) formed in the second fixing bracket 9 so as to be screwed with the nut 35. With this configuration, the first and second attaching brackets 30 and 31 are fixed on the first and second fixing brackets 8 and 9 that are fixed on the revolving frame 2*a*, and consequently the holding member 7 is fixed onto the revolving frame 2*a*.

In the present embodiment, a hole formed in the attaching plate 7*b*1 of the second plate member 7*b*, into which the bolt 20 illustrated in FIG. 6 is inserted, can be formed as a slotted hole. Similarly, a hole formed in the attaching plate 7*c*1 of the third plate member 7*c*, into which the bolt 22 illustrated in FIG. 7 is inserted, can be formed as a slotted hole.

According to the present embodiment configured as the above, it is possible to secure the strength of the projecting parts 6*a* and the strength of the side surface near the projecting parts 6*a* because a plurality of the projecting parts 6*a* are formed on the side surface of the hydraulic oil tank 6. This makes it possible to prevent a hydraulic oil tank from being deformed and damaged in the process of an operation performed by the working device, which is caused by increase or reduction of pressure within the tank due to heaving of the level of hydraulic oil stored therein. Consequently, it is possible to increase the durability of the hydraulic oil tank 6.

Furthermore, according to the present embodiment, it is possible to hold the hydraulic oil tank 6 without forming portions for supporting and fixing the hydraulic oil tank 6 in the inside thereof because the holding member 7 for holding the hydraulic oil tank 6, which is arranged out of the hydraulic oil tank 6 so as to surround the side surfaces thereof, holds the hydraulic oil tank 6 via the projecting part 6*a* that is formed on the side surface thereof. With this configuration, it is possible to secure a larger capacity of the hydraulic oil tank 6 and thus improve an operation performance of the compact excavator. When the capacity of the tank is set to be equal to the conventional hydraulic oil tank, it is possible to realize downsizing of the hydraulic oil tank 6. Moreover, as in the case of the compact excavator where a space for installing the devices is so small that a position for installing the devices is restricted, it is possible to increase the flexibility for layout design of them to be installed around the hydraulic oil tank 6.

Furthermore, according to the present embodiment, it is possible to realize a more reliable hydraulic oil tank attachment structure because damage of the projecting part 6*a*, which results from contact between the projecting part 6*a* of the hydraulic oil tank 6 made of synthetic resin and a periphery of the hole 11 of the iron flat plate member, can be prevented by the bushing 10 formed in the shape of a ring and having elasticity.

Furthermore, according to the present embodiment, it is possible to simplify the production process of the holding member 7 and reduce in production cost thereof because the holding member 7 is simply configured by the first plate member 7*a*, the second plate member 7*b*, and the third plate member 7*c*, which are respectively made of flat plates. In addition, the holding member 7 holds the hydraulic oil tank 6 so as to surround the three side surfaces of the hydraulic oil tank 6 that is mounted on the bottom plate 7*a*1 of the first plate member 7*a*, and accordingly it is possible to stably hold the hydraulic oil tank 6 with respect to shaking caused in association with an operation performed by the working device. In this point, it is also possible to realize the more reliable hydraulic oil tank attachment structure.

Furthermore, according to the present embodiment, the holes 17 and 18 for reduction in weight are respectively formed in the second plate member 7*b* and the third plate member 7*c*, and accordingly it is possible to reduce the weight of the holding member 7 and a load on the revolving frame 2*a*, which is generated by the hydraulic oil tank attachment structure, can be reduced. In this point, it is also possible to realize the more reliable hydraulic oil tank attachment structure.

Furthermore, according to the present embodiment, the hydraulic oil tank 6 is held via the attaching brackets 30 and 31 that are provided on the bottom surface of the bottom plate 7*a*1 of the first plate member 7*a* and the fixing brackets 8 and 9 that are provided on the revolving frame 2*a*, and accordingly it is possible to stably hold the hydraulic oil tank 6 at a desired height and secure the flexibility for layout design of the hydraulic oil tank 6.

As described above, when a slotted hole is formed in any of the second plate member 7*b* and the third plate member 7*c* so that the first plate member 7*a* is screwed with the first plate member 7*a* via the bolts 20 and 21 that are inserted into the slotted hole, it is possible to easily attach the second plate member 7*b* and the third plate member 7*c* to the first plate member 7*a*.

EXPLANATION OF REFERENCES

2 revolving superstructure
2*a* revolving frame
4 working-device attachment portion
6 hydraulic oil tank
6*a* projecting part
7 holding member
7*a* first plate member
7*a*1 bottom plate
7*a*2 standing plate
7*b* second plate member
7*b*1 attaching plate
7*b*2 side plate
7*c* third plate member
7*c*1 attaching plate
7*c*2 side plate
8 first fixing bracket
9 second fixing bracket
10 bushing
11 hole
15 hole
17 hole
18 hole
30 first attaching bracket
31 second attaching bracket

The invention claimed is:

1. A hydraulic oil tank attachment structure of a construction machine provided with a revolving superstructure, a working device that is attached to the revolving superstructure, a hydraulic actuator including a revolving motor that drives the revolving superstructure and an actuator that drives the working device, and a hydraulic oil tank made of synthetic resin, which stores therein a hydraulic oil to be supplied to the hydraulic actuator and is attached on a revolving frame of the revolving superstructure, comprising a holding member engaged by a projecting part formed on a side surface of the hydraulic oil tank, wherein the holding member is fixed onto the revolving frame of the revolving superstructure and surrounds side surfaces of the hydraulic oil tank to hold the hydraulic oil tank via the projecting part, wherein the holding member that is formed to be vertically extended includes:

an iron plate member provided with a hole formed therein; and a bushing having elasticity, which is formed in the shape of a ring and fitted to the hole of the plate member of the holding member, the projecting part of the hydraulic oil tank is inserted into the bushing that is fitted to the hole of the plate member to hold the hydraulic oil tank, the plate member is one of a plurality of plate members that include:

a first plate member having a bottom plate that is attached onto the revolving frame and a standing plate that is coupled to the bottom plate and is formed to be vertically extended, a second plate member having an attaching plate that is attached to the standing plate of the first plate member and is formed to be vertically extended and a side plate that is coupled to the attaching plate and is formed to be vertically extended, and a third plate member having an attaching plate that is attached to the standing plate of the first plate member and is formed to be vertically extended and a side plate that is coupled to the attaching plate of the third plate member, arranged so as to face the side plate of the second plate member, and formed to be vertically extended, holes to which bushings are fitted are respectively formed in the side plate of the second plate member and the side plate of the third plate member, and the hydraulic oil tank is mounted on the bottom plate of the first plate member and is held by the first plate member, the second plate member, and the third plate member such that the standing plate of the first plate member, the side plate of the second plate member, and the side plate of the third plate member surround three side surfaces of the hydraulic oil tank.

2. The hydraulic oil tank attachment structure of a construction machine according to claim 1, wherein a hole that accommodates a connecting part for connecting a supplying pipe that is provided in a bottom of the hydraulic oil tank is formed in the bottom plate of the first plate member, a hole for reduction in weight is formed in the side plate of the second plate member, and a hole for reduction in weight is formed in the side plate of the third plate member.

3. The hydraulic oil tank attachment structure of a construction machine according to claim 2, wherein a fixing bracket is provided on the revolving frame and an attaching bracket that is attached to the fixing bracket is provided on an under surface of the bottom plate.

4. The hydraulic oil tank attachment structure of a construction machine according to claim 1, wherein a fixing bracket is provided on the revolving frame and an attaching bracket that is attached to the fixing bracket is provided on an under surface of the bottom plate.

* * * * *